US010215047B2

(12) United States Patent
Moniz et al.

(10) Patent No.: US 10,215,047 B2
(45) Date of Patent: Feb. 26, 2019

(54) ACTUATION SYSTEM UTILIZING MEMS TECHNOLOGY

(71) Applicant: General Electric Company, Schenectady, NY (US)

(72) Inventors: Thomas Ory Moniz, Loveland, OH (US); Joseph George Rose, Mason, OH (US); Robert Joseph Orlando, West Chester, OH (US); Chenyu Jack Chou, Huntsville, AL (US)

(73) Assignee: General Electric Company, Schenectady, NY (US)

( * ) Notice: Subject to any disclaimer, the term of this patent is extended or adjusted under 35 U.S.C. 154(b) by 532 days.

(21) Appl. No.: 14/981,548

(22) Filed: Dec. 28, 2015

(65) Prior Publication Data

US 2017/0183976 A1 Jun. 29, 2017

(51) Int. Cl.

| | |
|---|---|
| ***F04D 15/00*** | (2006.01) |
| ***F01D 17/14*** | (2006.01) |
| ***F01D 17/10*** | (2006.01) |
| ***F01D 15/08*** | (2006.01) |
| ***F04B 43/04*** | (2006.01) |
| ***F04B 9/02*** | (2006.01) |
| ***F04B 53/10*** | (2006.01) |

(Continued)

(52) U.S. Cl.

CPC ..... *F01D 17/145* (2013.01); *F01D 15/08* (2013.01); *F01D 17/105* (2013.01); *F01D 17/162* (2013.01); *F01D 17/20* (2013.01); *F04B 9/02* (2013.01); *F04B 43/0081* (2013.01); *F04B 43/04* (2013.01); *F04B 53/10* (2013.01); *F04B 53/16* (2013.01); *F04D 29/522* (2013.01); *F05D 2220/32* (2013.01); *F05D 2240/12* (2013.01); *F05D 2270/80* (2013.01)

(58) Field of Classification Search

None

See application file for complete search history.

(56) References Cited

U.S. PATENT DOCUMENTS

| | | | |
|---|---|---|---|
| 2,445,439 | A | 7/1948 | King |
| 2,840,094 | A | 6/1958 | Taplin |

(Continued)

FOREIGN PATENT DOCUMENTS

| | | | |
|---|---|---|---|
| CN | 101161883 | A | 4/2008 |
| CN | 102235372 | A | 11/2011 |

OTHER PUBLICATIONS

Extended European Search Report and Opinion issued in connection with corresponding EP Application No. 16205159.3 dated May 19, 2017.

(Continued)

*Primary Examiner* — Igor Kershteyn
*Assistant Examiner* — Jason Fountain
(74) *Attorney, Agent, or Firm* — General Electric Company; Pamela Kachur

(57) ABSTRACT

An actuator includes a pump including a first cavity and a diaphragm coupled in flow communication with the first cavity. The diaphragm is configured to pressurize a fluid contained in the first cavity. The pump further includes a first valve coupled in flow communication with the first cavity. The first valve is configured to release fluid from the first cavity when the first cavity is pressurized. The actuator also includes a piston assembly operatively coupled to the pump.

17 Claims, 8 Drawing Sheets

(51) Int. Cl.

| | |
|---|---|
| ***F04B 53/16*** | (2006.01) |
| ***F04B 43/00*** | (2006.01) |
| ***F04D 29/52*** | (2006.01) |
| ***F01D 17/16*** | (2006.01) |
| ***F01D 17/20*** | (2006.01) |

(56) References Cited

U.S. PATENT DOCUMENTS

| | | | | |
|---|---|---|---|---|
| 2,933,236 | A | 4/1960 | Mathieson | |
| 3,362,156 | A * | 1/1968 | McLean | F01D 17/16 415/160 |
| 3,838,946 | A | 10/1974 | Schall | |
| 4,695,220 | A | 9/1987 | Dawson | |
| 4,973,077 | A | 11/1990 | Kuwayama et al. | |
| 6,086,041 | A | 7/2000 | Gattuso et al. | |
| 6,105,904 | A | 8/2000 | Lisy et al. | |
| 6,685,143 | B1 | 2/2004 | Prince et al. | |
| 7,036,312 | B2 | 5/2006 | Menard et al. | |
| 7,045,932 | B2 | 5/2006 | Xu et al. | |
| 7,106,493 | B2 | 9/2006 | Sanford | |
| 7,360,750 | B2 | 4/2008 | Yano et al. | |
| 7,548,833 | B2 | 6/2009 | Ahmed | |
| 7,665,670 | B2 * | 2/2010 | Ahmed | F23N 5/20 236/1 B |
| 7,849,870 | B2 | 12/2010 | DuPuis et al. | |
| 7,876,026 | B2 | 1/2011 | Pulskamp et al. | |
| 8,909,454 | B2 | 12/2014 | Minto | |
| 2005/0254938 | A1 | 11/2005 | Sheath et al. | |
| 2011/0174380 | A1 | 7/2011 | Itafuji et al. | |
| 2012/0269613 | A1 | 10/2012 | Mills et al. | |
| 2012/0275912 | A1 | 11/2012 | Moniz et al. | |
| 2013/0243630 | A1 | 9/2013 | Simmons et al. | |
| 2013/0276425 | A1 | 10/2013 | Rittenhouse | |

OTHER PUBLICATIONS

First Office Action and Search issued in connection with corresponding CN Application No. 201611234085.5 dated Apr. 2, 2018.

* cited by examiner

ACTUATION SYSTEM UTILIZING MEMS TECHNOLOGY

BACKGROUND

The field of the disclosure relates generally to gas turbine engines and, more particularly, to a system for actuating movable components of gas turbine engines using piston driven actuators.

Gas turbine engines typically include one or more movable components such as variable stator vanes (VSVs) and variable bleed valve (VBV) doors. In known gas turbine engines, VSVs and VBV doors are movable as a set using piston-based actuators driven with dedicated hydraulic lines. In such known gas turbine engine piston-based actuators, because of weight and space considerations, dedicated hydraulic lines represent a substantial burden on improved engine performance, including in terms of specific fuel consumption (SFC). Further, the dedicated hydraulic lines in such known piston-based actuators require a number of dedicated control systems and take up a substantial amount of space.

Furthermore, such known gas turbines utilizing known hydraulically actuated piston-based actuators are unable to effectively actuate VSVs and VBV doors individually. Rather, due to space and weight constraints, VSVs and VBV doors are actuated more than one individual component at a time in a set. As such, such known piston-based actuators are unable to effect independent modulation of VSV stages and VBV doors to accomplish, for example, active stall control for higher pressure ratios. Moreover, utilizing known hydraulically actuated piston-based actuators is limited in the displacement of VSVs and VBV doors, and therefore place limits on performance of such known gas turbine engines including advanced compressor designs and high speed boosters that are required for active stall control.

BRIEF DESCRIPTION

In one aspect, an actuator is provided. The actuator includes a pump including a first cavity and a diaphragm coupled in flow communication with the first cavity. The diaphragm is configured to pressurize a fluid contained in the first cavity. The pump further includes a first valve coupled in flow communication with the first cavity. The first valve is configured to release fluid from the first cavity when the first cavity is pressurized. The actuator also includes a piston assembly operatively coupled to the pump.

In another aspect, an actuation system for a gas turbine engine is provided. The gas turbine engine includes at least one movable component and at least one immovable component. The actuation system includes at least one actuator that includes a pump. The pump includes a first cavity and a diaphragm coupled in flow communication with the first cavity. The diaphragm is configured to pressurize a fluid contained in the first cavity. The pump further includes a first valve coupled in flow communication with the first cavity. The first valve is configured to release fluid from the first cavity when the first cavity is pressurized. The at least one actuator also includes a piston assembly operatively coupled to the pump. The at least one actuator is coupled to and between the at least one movable component and the at least one immovable component. The at least one actuator is configured to facilitate alternating movement of the at least one movable component relative to the at least one immovable component.

In yet another aspect, a gas turbine engine is provided. The gas turbine engine includes at least one movable component, at least one immovable component, and at least one actuator. The at least one actuator includes a pump that includes a first cavity and a diaphragm coupled in flow communication with the first cavity. The diaphragm is configured to pressurize a fluid contained in the first cavity. The pump further includes a first valve coupled in flow communication with the first cavity. The first valve is configured to release fluid from the first cavity when the first cavity is pressurized. The at least one actuator also includes a piston assembly operatively coupled to the pump. The at least one actuator is coupled to and between the at least one movable component and the at least one immovable component. The at least one actuator is configured to facilitate alternating movement of the at least one movable component relative to the at least one immovable component.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein:

FIG. 1 is a schematic illustration of an exemplary gas turbine engine.

FIG. 2 is a schematic illustration of a portion of an exemplary high pressure compressor (HPC) that may be used in the gas turbine engine shown in FIG. 1.

FIG. 3 is a perspective and cross-sectional schematic diagram of a portion of the exemplary HPC shown in FIG. 2.

FIG. 4 is an aft-to-forward perspective view of an exemplary actuation system utilizing micro-electromechanical systems (MEMS) that may be used in the HPC shown in FIGS. 2 and 3.

FIG. 5 is a forward-to-aft perspective and cross-sectional schematic diagram of an exemplary fan frame which may be used in the gas turbine engine shown in FIG. 1.

FIG. 6 is a forward-to-aft perspective and sectional view of an exemplary actuation system utilizing MEMS which may be used in the fan frame shown in FIG. 5.

FIG. 7 is a cross-sectional view of an exemplary embodiment of a MEMS actuator assembly which may be used in the gas turbine engine shown in FIG. 1.

FIG. 8 is a schematic view of an exemplary control scheme which may be used with the MEMS actuator assembly shown in FIG. 7.

Figure 1:
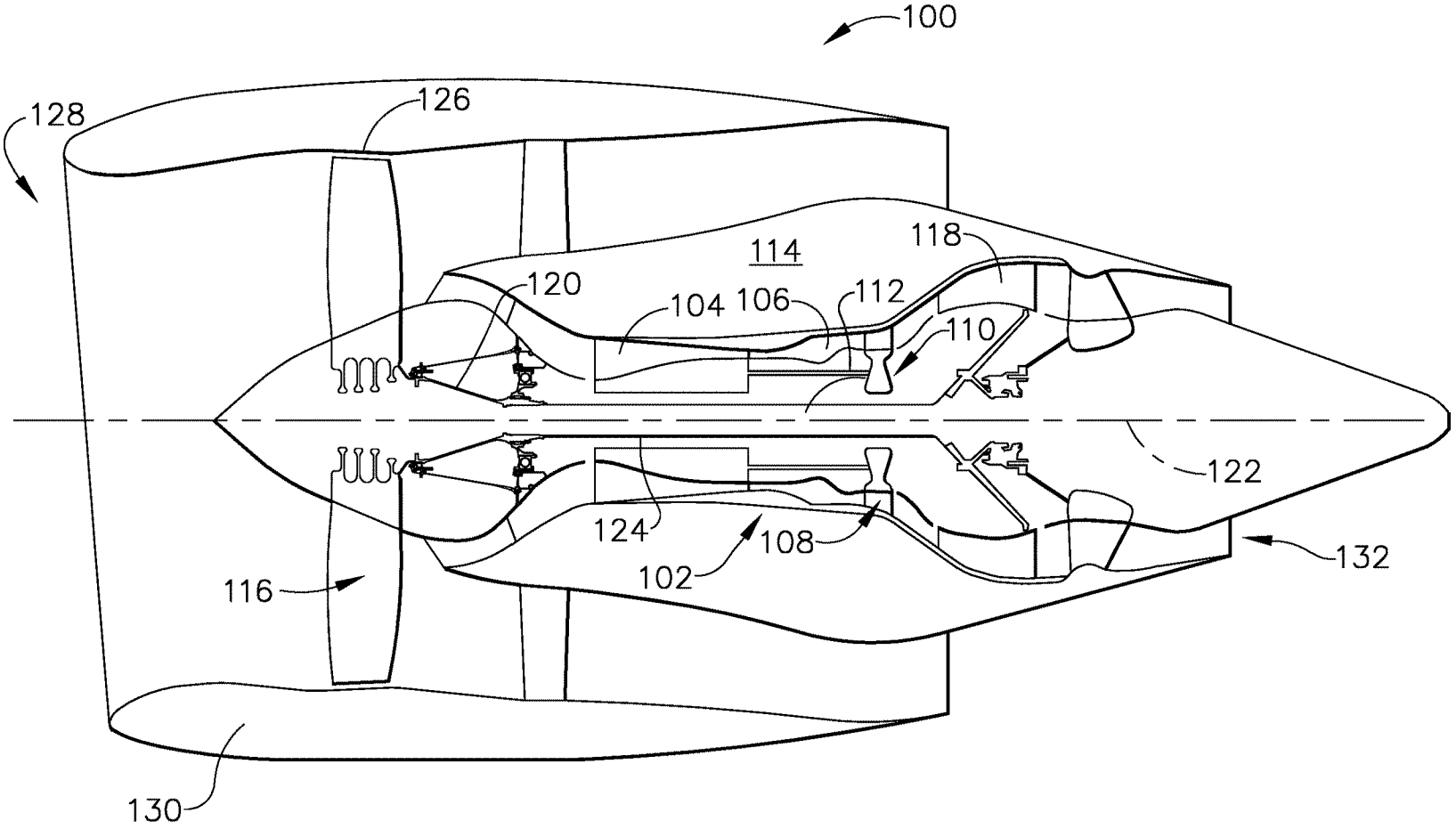
FIGS. 1-8 show example embodiments of the apparatus and method described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

The following detailed description illustrates embodiments of the disclosure by way of example and not by way of limitation. It is contemplated that the disclosure has general application to systems and methods for actuating movable components of gas turbine engines using microelectromechanical systems (MEMS) technology-based actuators.

Embodiments of the actuation systems utilizing MEMS technology described herein effectively actuate movable components of gas turbine engines such as variable stator vanes (VSVs) and variable bleed valve (VBV) doors without using dedicated hydraulic lines or dedicated pressure sources such as hydraulic pumps. Also, the actuation systems utilizing MEMS technology described herein enable individual modulation of VSV stages and VBV doors in gas turbine engines to accomplish, for example, active stall control for higher pressure ratios. Further, the actuation systems utilizing MEMS technology described herein utilize MEMS-based mechanisms including, without limitation, piezoelectric effects, to generate rapid pulses with small displacements of an internally contained hydraulic medium, which coupled to an amplifier is able to achieve the necessary displacements required for VBV door and VSV control. Furthermore, the actuation systems utilizing MEMS technology described herein facilitate increased actuation ability of movable components of gas turbine engines such as VSVs and VBV doors within a smaller space envelope, using simpler packaging, and at a lesser weight relative to known piston-based actuation systems.

FIG. 1 is a schematic illustration of an exemplary gas turbine engine 100. Gas turbine engine 100 includes a gas generator or core engine 102 that includes a high pressure compressor (HPC) 104, a combustor assembly 106, and a high pressure turbine (HPT) 108 in an axial serial flow relationship on a core engine rotor 110 rotating about a core engine shaft 112. HPC 104, combustor assembly 106, HPT 108, core engine rotor 110, and core engine shaft 112 are located inside of an annular housing 114. Gas turbine engine 100 also includes a low pressure compressor (LPC) or fan 116 and a low pressure turbine (LPT) 118 arranged in an axial flow relationship on a power engine rotor 120.

In operation, in the exemplary gas turbine engine 100, air flows along a central axis 122, and compressed air is supplied by HPC 104. The highly compressed air is delivered to combustor assembly 106. Exhaust gas flows (not shown in FIG. 1) from combustor assembly 106 and drives HPT 108 and LPT 118. Power engine shaft 124 drives power engine rotor 120 and fan 116. Gas turbine engine 100 also includes a fan or LPC containment case 126. Also, in the exemplary gas turbine engine 100, an initial air inlet 128 located at the forward end of gas turbine engine 100 includes an annular inlet cowling 130 defining a circumferential boundary thereof. Throughout gas turbine engine 100, valves of various types, not shown, are present and control flow of various liquids and gases including, without limitation, fuel, intake air, and exhaust gas. At least some valves in gas turbine engine 100 establish temperature gradients between fluids and gases whereby fluids and gases on one side of the valve are at a higher or lower temperature than the other side of the valve. Further, gas turbine engine 100 includes an aft end including an exhaust outlet 132.

Figure 2:
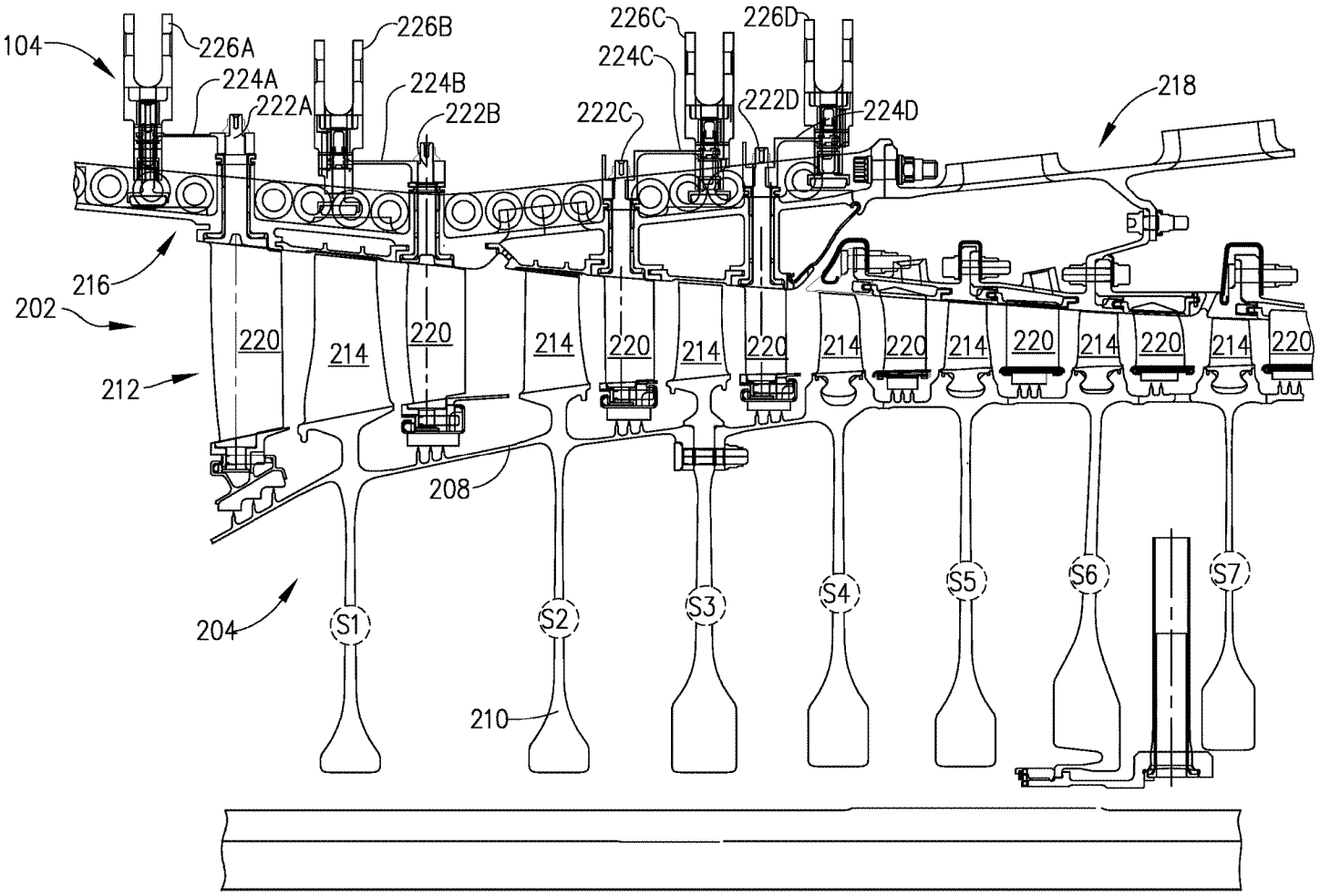

FIG. 2 is a schematic illustration of a portion of HPC 104 that may be used in the gas turbine engine 100 shown in FIG. 1. HPC 104 includes an inlet 202. Inlet 202 is the start of the main flowpath of air into HPC 104. HPC 104 also includes an axially-elongate annular spool 204 mounted for rotation about a centerline axis 206. Annular spool 204 may be built up from several smaller components. As such, annular spool 204 includes at least one drum portion 208 and at least one annular disk 210 which all rotate together as a unit. Annular spool 204 is depicted in half-section but it will be understood that it is a body of revolution. A plurality of blade rows 212 are carried at the outer periphery of annular spool 204. Each blade row 212 of the plurality of blade rows 212 includes an annular array of airfoil-shaped compressor blades 214 which extend radially outward from annular spool 204. An annular liner assembly 216 closely surrounds compressor blades 214 and defines the radially outer boundary of a primary gas flowpath through HPC 104. Liner assembly 216 is built up from a plurality of smaller components, some of which will be described in more detail below. An annular casing 218 surrounds liner assembly 216 and provides structural support to it. Several stator rows are carried by liner assembly 216. Each stator row comprises an annular array of airfoil-shaped stator vanes 220 which extend radially inward from liner assembly 216. Stator rows alternate with blade rows in the axial direction. Each blade row and the axially downstream stator row constitute a "stage" of HPC 104.

Also, in the exemplary HPC 104, the stages of HPC 104 which are shown are labeled sequentially "S1" through "S7". These numbers are used solely for the sake of easy reference and do not necessarily correspond to the actual number of the stages in the complete HPC 104. The four stages S1 through S4 shown on the left side of the figure (towards inlet 202 end of HPC 104) incorporate VSVs. Stator vanes 220 of these stages are constructed so that their angle of incidence can be changed in operation (i.e., these stator vanes 220 can be pivoted about the radial axes shown in dashed lines). The remaining stages to the right side of the figure (towards an exit end of the compressor, not shown) do not incorporate VSVs. Stator vane 220 of each stage S1 through S4 has a corresponding trunnion 222 (generically referred to as 222 and labeled 222A through 222D, respectively) that extends radially outward through liner assembly 216 and casing 218. An actuator arm (generically referred to as 224 and labeled 224A through 224D, respectively) is attached to radially outward ends of trunnions 222A-222D. All actuator arms 224A-224D for an individual stage are coupled together by a ring 226 (generically referred to as 226 and labeled 226A through 226D, respectively). A plurality of actuator arms 224A-224D are rotatable coupled to a plurality of rings 226A-226D in HPC 104.

In operation, HPC 104 draws air through inlet 202 and compresses it as it pumps it axially downstream. Each stage contributes an incremental pressure rise to the air, with the highest pressure being at the exit of the last stage. Combined with the constriction in diameter of the main flowpath, the effect is to eject highly compressed air through HPC 104 toward combustor assembly 106, not shown, at a high velocity and pressure. Rotation of rings 226A-226D about centerline axis 206 causes all actuator arms 224 coupled to that specific ring 226A-226D to move in unison, in turn pivoting all trunnions 222A-222D with their attached VSV-type stator vanes 220 in unison. VSVs enable throttling of flow through HPC 104 so that it can operate efficiently at both high and low mass flow rates. Consequently, rotation of at least one of rings 226A-226D enables at least one of the VSVs to assume required angles of incidence relative to incoming air in the main flowpath of HPC 104.

Figure 3:
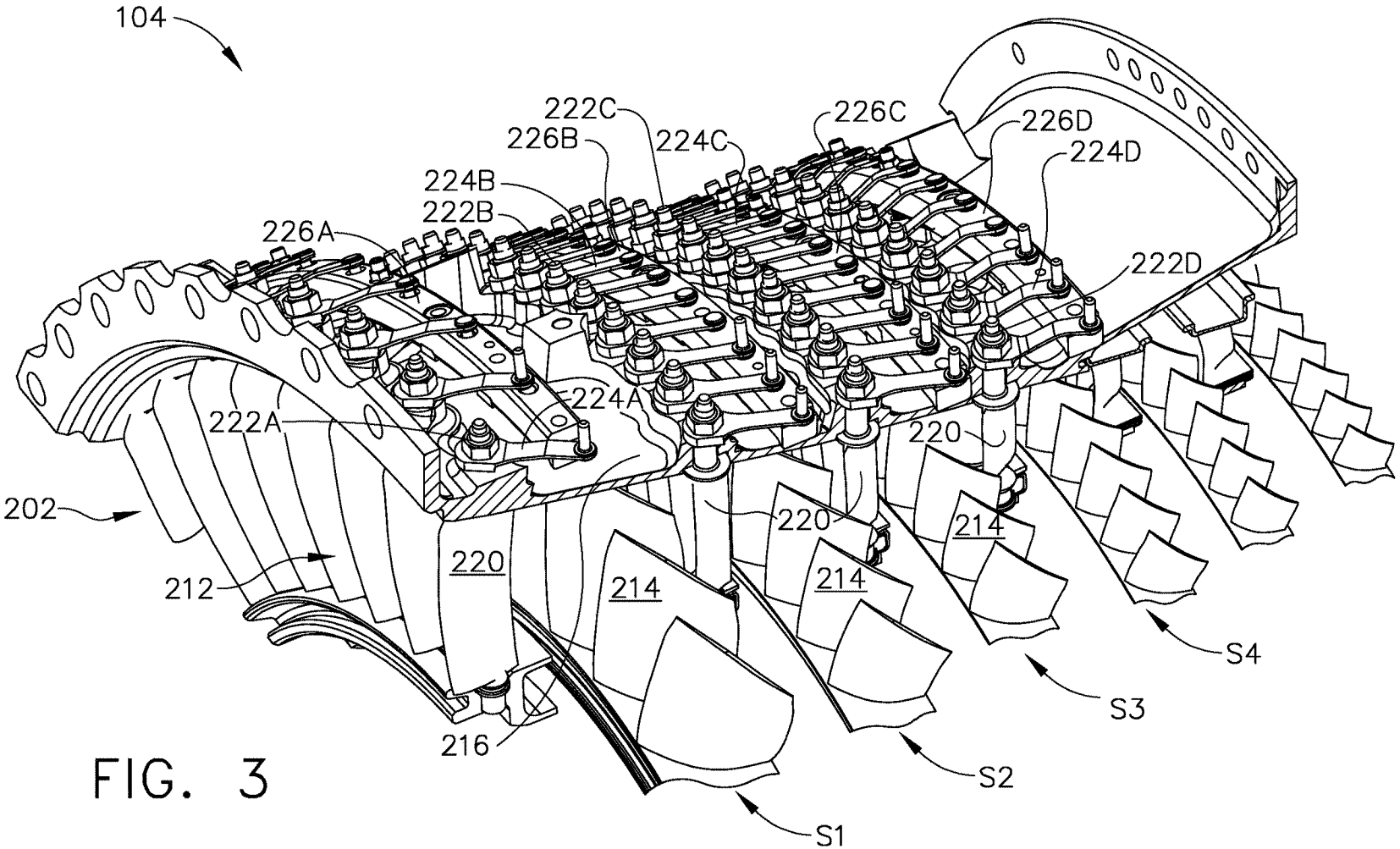

FIG. 3 is a perspective and cross-sectional schematic diagram of a portion of the exemplary HPC 104 shown in FIG. 2. As shown and described above with reference to FIG. 2, HPC 104 includes inlet 202, rings 226A-226D, actuator arms 224A-224D, trunnions 222A-222D, and stator vanes 220 coupled thereto. Also, in the exemplary HPC 104, stator vanes 220 are VSVs coupled to trunnions 222A-222D of stages S1 through S4. Operation of the exemplary embodiment is as described above with reference to FIG. 2. Additional numbered features of exemplary HPC 104 are shown in FIG. 3 to facilitate cross-referencing FIG. 3 with FIGS. 1 and 2.

Figure 4:
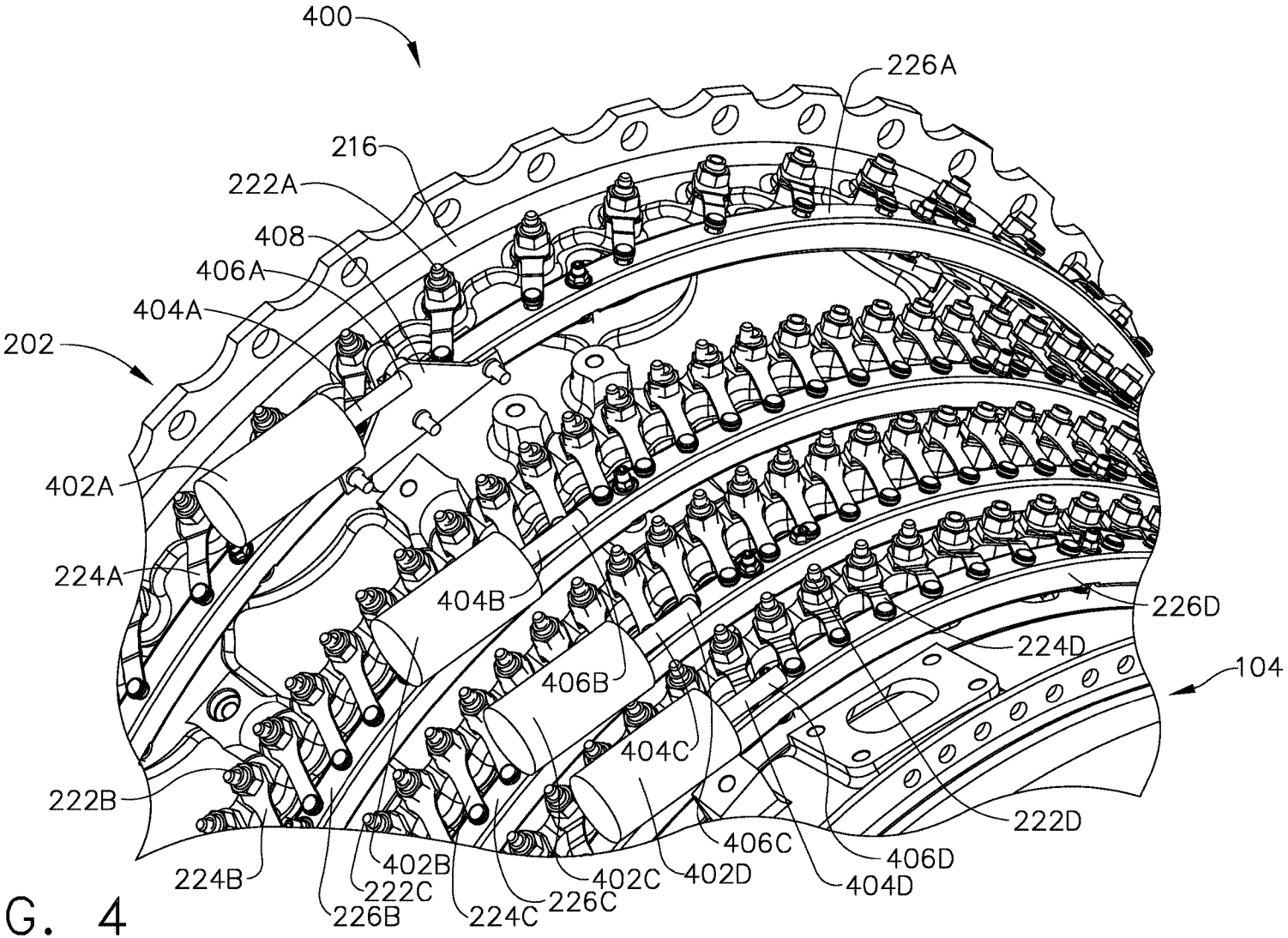

FIG. 4 is an aft-to-forward perspective view of an exemplary actuation system utilizing MEMS 400 that may be used in HPC 104 shown in FIGS. 2 and 3. In the exemplary embodiment, actuation system utilizing MEMS 400 includes a MEMS actuator 402 (generically referred to as 402 and labeled 402A through 402D, respectively) coupled to at least a portion of liner assembly 216. In other alternative embodiments, not shown, MEMS actuator 402 is coupled to other portions of gas turbine engine 100, not shown, other than liner assembly 216, or to combinations thereof. MEMS actuator 402 includes a piston assembly 404 (generically referred to as 404 and labeled 404A through 404D, respectively). Piston assembly 404 extends laterally from actuator 402, and is configured to alternately move laterally outward, i.e., extend, and laterally inward, i.e., retract, in response to commands from a controller, not shown in FIG. 4. Also, in the exemplary embodiment, a distal end 406 (generically referred to as 406 and labeled 406A through 406D, respectively) of each piston assembly 404 of piston assemblies 404A-404D is coupled to at least one bracket 408 at a radially outward portion thereof. At least one radially inward portion of bracket 408 is coupled to an axially aft side of each ring 226 of the plurality of rings 226A-226D. In other alternative embodiments, not shown, at least one radially inward portion of bracket 408 is coupled to an axially forward side of each ring 226 of the plurality of rings 226A-226D. Additional numbered features of exemplary actuation system utilizing MEMS 400 are shown in FIG. 4 to facilitate cross-referencing FIG. 4 with foregoing figures.

In operation, in the exemplary embodiment, actuation system utilizing MEMS 400 is configured for actuating rotation of VSVs in HPC 104. As shown and described above with reference to FIGS. 2 and 3, rings 226A-226D surround liner assembly 216 of HPC 104. A plurality of actuator arms 224A-224D are rotatably coupled to radially outward surfaces of rings 226A-226D. In other alternative embodiments, not shown, the plurality of actuator arms 224A-224D are rotatably coupled to radially inward surfaces of rings 226A-226D. Actuator arms 224A-224D extend axially forward from rings 226A to 226D and are coupled to trunnions 222A-222D, which penetrate through liner assembly 216. In an alternative embodiment, not shown, actuator arms 224A-224D extend axially aft from rings 226A to 226D. On radially inward surfaces of liner assembly 216, radially outward ends of VSVs, not shown, are coupled to radially inward ends of trunnions 222A-222D, as shown and described above with reference to FIG. 2. The alternating extension and retraction of piston assemblies 404A-404D exerts a force upon rings 226A-226D, thereby rotating rings 226A-226D alternately clockwise and counterclockwise with respect to centerline axis 206, not shown. With the resulting circumferential movement of rings 226A-226D, VSVs are likewise rotated alternately clockwise and counterclockwise in response to commands from a controller, not shown. Consequently, rotation of at least one of rings 226A-226D enables at least one of the VSVs to assume required angles of incidence relative to incoming air in the main flowpath of HPC 104.

Figure 5:
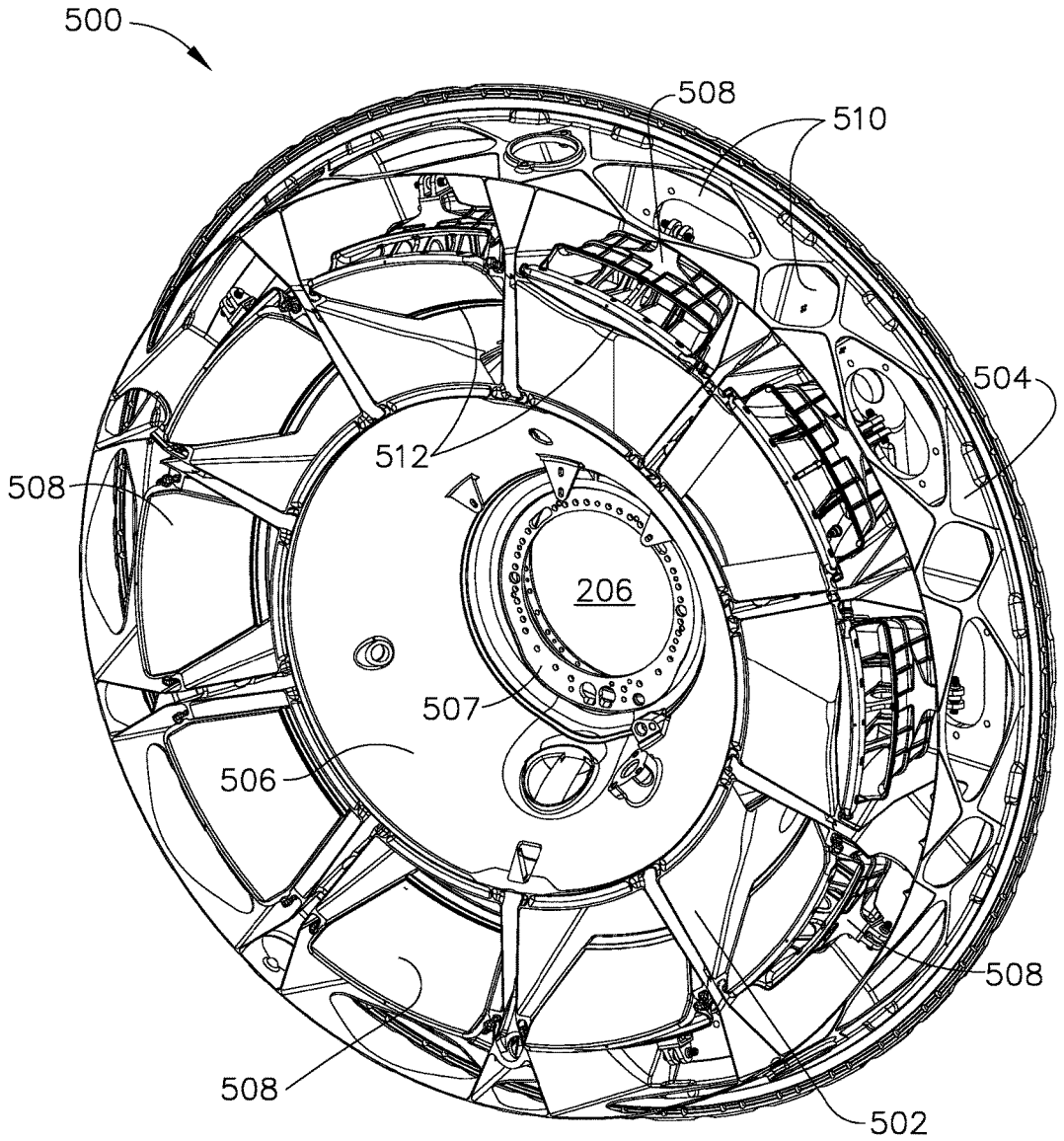

FIG. 5 is a forward-to-aft perspective and cross-sectional schematic diagram of an exemplary fan frame 500 which may be used in the gas turbine engine 100 shown in FIG. 1. Fan frame 500 includes a plurality of fan frame struts 502 coupled to and disposed within a fan outer guide vane (OGV) support ring 504. Also, in the exemplary embodiment, each fan frame strut 502 of the plurality of fan frame struts 502 is coupled to and between fan OGV support ring 504 and an annular inner casing 506. Annular inner casing 506 includes an inner hub bearing support structure 507 circumscribing a void in an aft portion of annular inner casing 506. Further, in the exemplary embodiment, fan OGV support ring 504 and annular inner housing are arranged circumferentially about centerline axis 206, and fan frame struts 502 are arranged radially about axis centerline 206. Furthermore, in the exemplary embodiment, a plurality of variable bleed valve (VBV) doors 508 are arranged circumferentially about centerline axis 206. Each VBV door 508 of the plurality of VBV doors 508 is disposed circumferentially about centerline axis 206 between two adjacent fan frame struts 502. Moreover, in the exemplary embodiment, fan frame 500 includes an annular aft plate 510 extending radially inward from radially inward surfaces of aft portions of annular fan casing. Radially inward edges of annular aft plate 510 include generally forward extending lips 512 to which VBV doors 508 are coupled, as further shown and described below with reference to FIG. 6.

In operation, in the exemplary fan frame 500, fan frame struts 502 serve as structural members (sometimes referred to as "fan struts") which connect outer fan OGV support ring 504 to annular inner casing 506. However, in other alternative embodiments, not shown, these support functions may be served by separate components. VBV doors 508 actuate alternately radially inward and radially outward to alternately close and open the space defined between adjacent fan frame struts 502, as further shown and described below with reference to FIG. 6.

Figure 6:
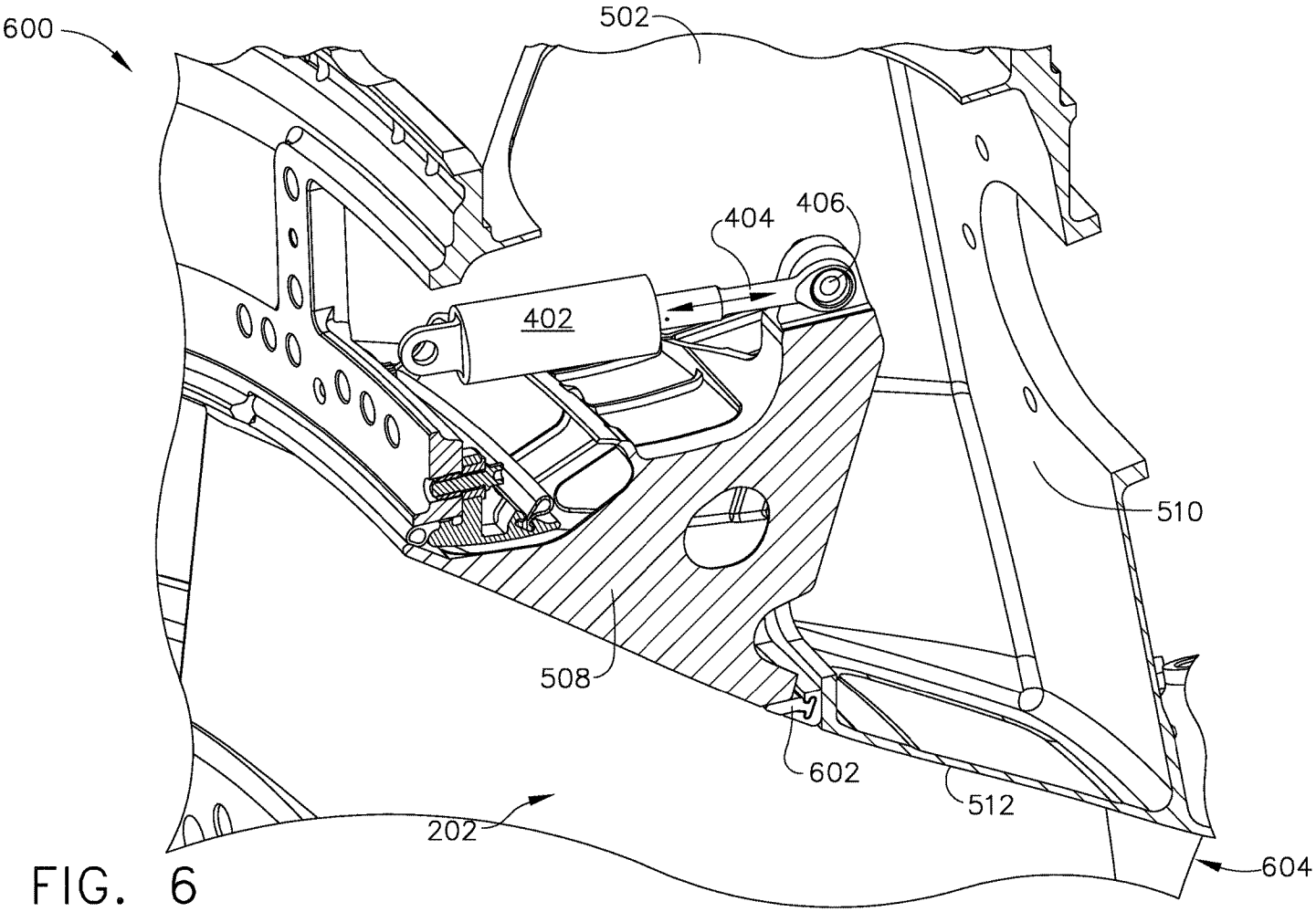

FIG. 6 is a forward-to-aft perspective and sectional view of an exemplary actuation system utilizing MEMS 600 which may be used in fan frame 500 shown in FIG. 5. In the exemplary embodiment, a radially inward and aft edge of VBV door 508 is coupled to lip 512 at a hinge 602. Also, in the exemplary embodiment, actuation system utilizing MEMS 600 includes MEMS actuator 402 coupled to VBV door 508 at generally forward portions thereof. MEMS actuator 402 includes piston assembly 404 extending aftward therefrom. Piston assembly 404 is coupled to at least a portion of annular aft plate 510 at distal end 406, i.e., an aft end of piston assembly 404.

In operation, in the exemplary actuation system utilizing MEMS 600, MEMS actuator 402 is configured for actuating rotation of VBV door 508 about hinge 602. As shown and described above with reference to FIG. 5, a plurality of VBV doors 508 arranged circumferentially about centerline axis 206 are actuated by a plurality of MEMS actuators 402 alternately radially inward and radially outward to alternately close and open the space defined between adjacent fan frame struts 502. The space defined between adjacent fan frame struts 502 includes inlet 202 into HPC 104, not shown. The alternating extension and retraction of piston assembly 404 from MEMS actuator 402 exerts a force upon VBV door 508 about hinge 602, thereby facilitating control of air flow into inlet 202 of HPC 104. Also, in operation of the exemplary embodiment, each VBV door 508 of the plurality of VBV doors 508 of fan frame 500 are individually actuateable by individually coupled MEMS actuators 402 coupled thereto.

Also, in operation of the exemplary actuation system utilizing MEMS 600, individual actuation of individual VBV doors 508 is advantageous in gas turbine engines 100 under operating conditions including, without limitation, non-axisymmetric inlet flow conditions. Further, in operation of the exemplary actuation system utilizing MEMS 600, secondary air systems in gas turbine engines 100, not shown, are bled from at least one VBV door outlet 604 to enable improved secondary air flow by facilitating additional air flow at individual VBV door 508 locations. In other alternative embodiments, not shown, each MEMS actuator 402 of the plurality of MEMS actuators may be configured to actuate all VBV doors 508 in fan frame 500 at the same time, i.e., on the same schedule. In still other embodiments, not shown, subsets of MEMS actuators 402 of the plurality of MEMS actuators in fan frame 500 may be configured to subsets of VBV doors 508 at the same time, including, without limitation, quadrants of VBV doors 508.

Figure 7:
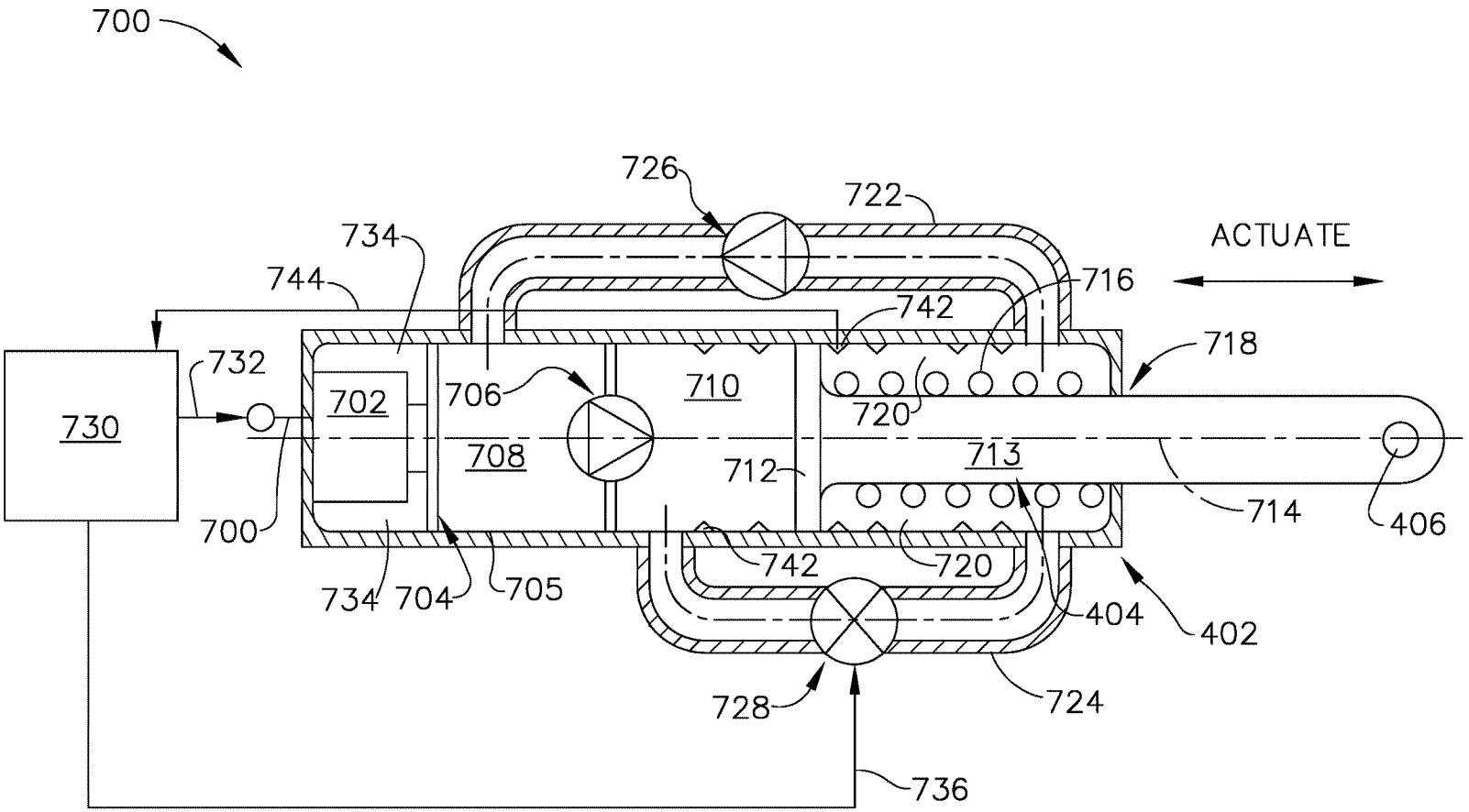

FIG. 7 is a cross-sectional view of an exemplary embodiment of a MEMS actuator assembly 700 which may be used in the gas turbine engine 100 shown in FIG. 1. In the exemplary embodiment, MEMS actuator assembly 700 includes MEMS actuator 402. MEMS actuator 402 includes a MEMS module 702 coupled to a diaphragm 704. MEMS actuator 402 includes a sealed body 705, i.e., a pump, defined by the outside walls of MEMS actuator 402. Sealed body 705 further defines an interior of MEMS actuator 402, i.e., an interior of a pump. Inside of MEMS actuator 402 is coupled a first one-way valve 706 separating a first cavity 708 from a second cavity 710. MEMS actuator 402 also includes a piston head 712 from which a piston shaft 713 of piston assembly 404 extends axially outside of MEMS actuator 402 along an axis 714. Second cavity 710 is defined between a piston head 712 and first one-way valve 706. MEMS actuator 402 further includes a spring 716, i.e., as a bias member. Spring 716 is disposed circumferentially around a piston assembly 404. Spring 716 extends axially inside of MEMS actuator 402 along a piston assembly 404 between a piston head 712 and a piston exit 718. As such, spring 716 resides within a third cavity 720 inside of MEMS actuator 402.

Also, in the exemplary embodiment, MEMS actuator assembly 700 includes a first hydraulic line 722 extending between third cavity 720 and first cavity 708. MEM actuator assembly 700 also includes a second hydraulic line 724 extending between third cavity 720 and second cavity 710. A second one-way valve 726 permits flow through first hydraulic line 722 from third cavity 720 to first cavity 708. A reset valve 728 permits flow between third cavity 720 and second cavity 710.

Further, in the exemplary embodiment, MEMS actuator assembly 700 includes a MEMS controller 730 communicatively coupled to MEMS module 702. MEMS controller 730 is configured to transmit a MEMS control signal 732 to MEMS module 702 to facilitate commanded alternating movement of diaphragm 704. Diaphragm 704 separates first cavity 708 from a fourth cavity 734 within which MEMS module 702 resides inside of MEMS actuator 402. In alternative embodiments, not shown, MEMS module 702 resides in or on other portions of MEMS actuator 402. Furthermore, in the exemplary embodiment, first one-way valve 706 and second one-way valve 726 are passive, i.e., uncontrolled, valves.

MEMS controller 730 is configured to transmit a reset valve control signal 736 to reset valve 728 to facilitate commanded alternating opening and closing of reset valve 728. In an alternative embodiment, not shown, MEMS controller is further configured to transmit at least one of a first one-way valve control signal 738 to first one-way valve 706 and a second one-way valve control signal 740 to facilitate commanded alternating opening and closing of first one-way valve 706 and second one-way valve 726, respectively. MEMS actuator assembly 700 includes at least one position sensor 742 coupled to MEMS actuator 402 along interior surfaces thereof facing second cavity 710 and third cavity 720. In alternative embodiments, not shown, position sensor(s) 742 are not present, or are coupled to or on other portions of MEMS actuator 402. Position sensor 742 is configured to detect a present position of piston assembly 404, including, without limitation, the present position of piston head 712, and transmit a position feedback signal 744 to MEMS controller 730 to facilitate comparison and correction between a commanded position of piston assembly 404 and the present position of piston assembly 404, as further described below with reference to FIG. 8. In other alternative embodiments, not shown, MEMS controller 730 transmits and receives signals other than MEMS control signal 732, reset valve control signal 736, and position feedback signal 744 to and from elsewhere in either actuation system utilizing MEMS 400 or actuation system utilizing MEMS 600, or both. In still other alternative embodiments, not shown, at least one of first one-way valve 706 and second one-way valve 726 are replaced with two-way valves in the same positions thereof, thus facilitating positive travel of piston assembly 404 in two directions in MEMS actuator assembly 700.

In operation each of first cavity 708, second cavity 710, third cavity 720, first hydraulic line 722, and second hydraulic line 724 are filled with a hydraulic fluid. MEMS actuator assembly 700 is configured to establish and maintain at least four operational states for piston assembly 404: extension (distal end 406 moving to the right of FIG. 7), retraction (distal end 406 moving to the left of FIG. 7), stationary (piston assembly 404 does not move, but rather maintains its current position), and equilibration (piston assembly 404 is able to move freely in any direction).

In operation, to facilitate extension, MEMS controller 730 commands reset valve 728 to close, and further commands MEMS module 702 to initiate MEMS-based movement of diaphragm 704 including, without limitation, alternating and pulsating movement via piezoelectric effects. Movement of diaphragm 704 facilitates increased hydraulic pressure in first cavity 708 and, thereby in second cavity 710, through flow of hydraulic fluid through first one-way valve 706.

Such increased hydraulic pressure in second cavity 710 exerts a force upon piston head 712 to move it to the right in FIG. 7. Simultaneously with rightward movement of piston assembly 404, spring 716 undergoes compression facilitating potential energy storage therein. As piston head 712 extends to the right, increased hydraulic pressure in third cavity 720 is relieved to first cavity 708 via second one-way valve 726. The ordering and timing of commanded movement of diaphragm 704, including, without limitation, the number of pulses, dictate both the rate of and extent of extension of piston assembly 404.

In further operation, to facilitate retraction, MEMS controller 730 commands reset valve 728 to open. Opening of reset valve 728 facilitates equalization of hydraulic pressure between second cavity 710 and third cavity 720. As such, potential energy stored in spring 716 is converted into kinetic energy whereby spring 716 extends leftward and exerts a force upon piston head 712 facilitating movement of piston assembly 404 to the left in FIG. 7. The ordering and timing of commanded alternating opening and closing of reset valve 728 dictate both the rate of and extent of retraction of piston assembly 404 in the exemplary embodiment.

In still further operation, to facilitate the stationary operational state, MEMS controller 730 commands reset valve 728 to close. The stationary operational state is further facilitated by MEMS controller 730 not commanding movement of diaphragm 704. As a result, an equilibrium state is reached whereby the rightward force exerted upon piston head 712 by increased hydraulic pressure in second cavity 710 is balanced by the leftward force exerted upon piston head 712 by spring 716, in addition to forces exerted upon piston assembly 404 by movable components, not shown, of gas turbine engine 100, e.g., VSVs and VBV doors. Therefore, in the stationary operational state, piston assembly 404 remains stationary and does not move either to the left or to the right in FIG. 7.

In yet further operation, to facilitate the equilibration operational state, MEMS controller 730 commands reset valve 728 to open. The equilibration operational state is further facilitated by MEMS controller 730 not commanding movement of diaphragm 704. As a result, any difference in hydraulic pressures amongst first cavity 708, second cavity 710, and third cavity 720 is extinguished, and spring 716 exerts a force upon piston head 712 to the right in FIG. 7 which tends to return piston assembly 404 to a fully retracted position. As such, it is possible for piston assembly 404, along with movable components, not shown, of gas turbine engine 100 attached thereto, to be moved manually. Placement of MEMS actuator assembly 700 into the equilibration operational state is advantageous in gas turbine engine 100 during, by way of example, maintenance activities thereupon.

Figure 8:
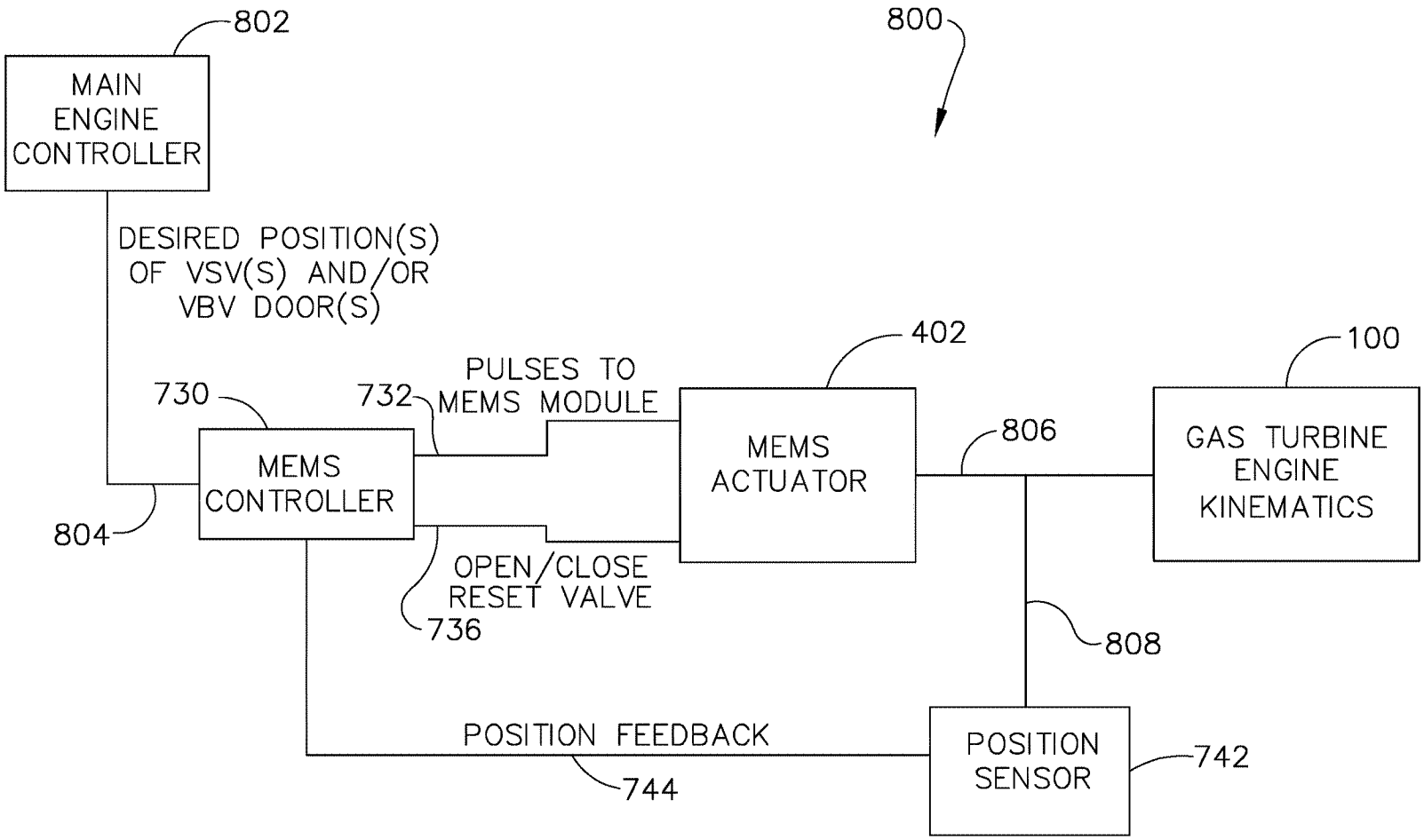

FIG. 8 is a schematic view of an exemplary control scheme 800 which may be used with the MEMS actuator assembly 700 shown in FIG. 7. In the exemplary embodiment, control scheme 800 includes a main engine controller 802, including, without limitation, a full authority digital engine (or electronics) control (FADEC), configured to receive operator-initiated commands for desired operational states of gas turbine engine 100, including, without limitation, positional states of VSV-type stator vanes 220 and VBV doors 508. Main engine controller 802 is further configured to transmit positional commands, including, without limitation, actuator commands 804 representing the desired position(s) of VSV-type stator vane(s) 220 and VBV door(s) 508, to MEMS controller 730. As shown and described above with reference to FIG. 7, MEMS controller 730 transmits at least one of MEMS control signal 732 and reset valve control signal 736 to MEMS actuator 402.

Also, in the exemplary control scheme 800, MEMS actuator 402 effects actuation of movable components of gas turbine engine 100 including, without limitation, VSV-type stator vane(s) 220 and VBV door(s) 508, via controlled movements 806 thereof. Controlled movements 806 of movable components of gas turbine engine 100 such as VSV-type stator vane(s) 220 and VBV door(s) 508 effect variations of the kinematics of gas turbine engine 100. Further, in the exemplary control scheme 800, MEMS actuator 402 includes at least one position sensor 742 configured to detect the present position of piston assembly 404, not shown, in MEMS actuator 402. Position sensor 742 is further configured to transmit a position feedback signal 744 to MEMS controller 730 to facilitate comparison and correction between the commanded position of piston assembly 404 and the present position of piston assembly 404. Upon receipt of position feedback signal 744 by MEMS controller 730, MEMS controller compares the present, i.e., resultant, position of piston assembly 404 with the commanded position of piston assembly 404 intended by the operator of gas turbine engine 100. Any deviation from the aforementioned two piston assembly 404 positions is corrected by MEMS controller 730, if necessary, by the issuance of at least one additional corrective control signal, including at least one additional MEMS control signal 732, reset valve control signal 736, first one-way valve control signal 738, and second one-way valve control signal 740 to MEMS actuator 402. As such, control scheme 800 facilitates continuous closed loop feedback for operators of gas turbine engines 100 to effect desired variations in the kinematics thereof.

The above-described embodiments of actuation systems utilizing MEMS technology effectively actuate movable components of gas turbine engines such as variable stator vanes (VSVs) and variable bleed valve (VBV) doors without using dedicated hydraulic lines. Also, the above-described embodiments of actuation systems utilizing MEMS technology make it possible to effect individual modulation of VSV stages and VBV doors in gas turbine engines to accomplish, for example, active stall control for higher pressure ratios. Further, the above-described embodiments of actuation systems utilizing MEMS technology utilize MEMS-based mechanisms including, without limitation, piezoelectric effects, to generate rapid pulses with small displacements of an internally contained hydraulic medium, which coupled to an amplifier is able to achieve the larger displacements required for VBV door and VSV control. Furthermore, the above-described embodiments of actuation systems utilizing MEMS technology facilitate increased actuation ability of movable components of gas turbine engines such as VSVs and VBV doors within a smaller space envelope, using simpler packaging, and at a lesser weight relative to known piston-based actuation systems.

Example systems and apparatus of actuation systems utilizing MEMS technology are described above in detail. The apparatus illustrated is not limited to the specific embodiments described herein, but rather, components of each may be utilized independently and separately from other components described herein. By way of example only, systems and apparatus of actuation systems utilizing MEMS technology may be used with movable components of gas turbine engines other than VSVs and VBV doors, including, without limitation, variable area bypass injectors (VABIs), variable area turbine nozzles (VATNs), variable exhaust nozzles (VENs), thrust reversers, and blocker doors, and any other actuated device found in any other system which similarly benefits from actuation systems utilizing MEMS technology described above. Each system component can also be used in combination with other system components.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An actuator comprising:

a pump comprising:

a first cavity;

a diaphragm coupled in flow communication with said first cavity, said diaphragm configured to pressurize a fluid contained in said first cavity; and a first valve coupled in flow communication with said first cavity, said first valve configured to release fluid from said first cavity when said first cavity is pressurized;

a piston assembly operatively coupled to said pump; and further comprising a micro-electromechanical systems (MEMS) controller and a MEMS module, said MEMS controller configured to transmit a MEMS control signal to said MEMS module to facilitate commanded movement of said diaphragm to pressurize said first cavity.

2. The actuator in accordance with claim 1, wherein said piston assembly further comprises a head and shaft, said actuator further comprising:

a second cavity defined between said first valve and said head;

a bias member configured to oppose a force acting on said head from said second cavity; and a third cavity configured to supply a flow of fluid to said first cavity when said shaft extends from said actuator, said third cavity configured to receive a flow of fluid from said second cavity when said shaft retracts into said actuator.

3. The actuator in accordance with claim 2 further comprising a second valve coupled in flow communication between said third cavity and said first cavity, said second valve configured to facilitate extension of said piston assembly.

4. The actuator in accordance with claim 3 further comprising a reset valve coupled in flow communication between said third cavity and said second cavity, said reset valve configured to facilitate retraction of said piston assembly.

5. The actuator in accordance with claim 4 wherein said MEMS controller is further configured to transmit a valve control signal to at least one of said first valve, said second valve, and said reset valve to facilitate commanded alternating opening and closing of at least one of said first valve, said second valve, and said reset valve.

6. The actuator in accordance with claim 1 further comprising at least one position sensor operatively coupled to said pump, said at least one position sensor configured to detect a present position of said piston and transmit a position feedback signal to said MEMS controller to facilitate comparison and correction between a commanded position of said piston and the present position of said piston.

7. An actuation system for a gas turbine engine, the gas turbine engine including at least one movable component and at least one immovable component, said actuation system comprising at least one actuator comprising:

a pump comprising:

a first cavity;

a diaphragm coupled in flow communication with said first cavity, said diaphragm configured to pressurize a fluid contained in said first cavity; and a first valve coupled in flow communication with said first cavity, said first valve configured to release fluid from said first cavity when said first cavity is pressurized;

a piston assembly operatively coupled to said pump, wherein said at least one actuator is coupled to and between the at least one movable component and the at least one immovable component, said at least one actuator configured to facilitate alternating movement of the at least one movable component relative to the at least one immovable component; and further comprising a micro-electromechanical systems (MEMS) controller and a MEMS module, said MEMS controller configured to transmit a MEMS control signal to said MEMS module to facilitate commanded movement of said diaphragm to pressurize said first cavity.

8. The actuation system in accordance with claim 7, wherein said piston further comprises a head and a shaft, said at least one actuator further comprising:

a second cavity defined between said first valve and said head;

a bias member configured to oppose a force acting on said head from said second cavity;

a third cavity configured to supply a flow of fluid to said first cavity when said shaft extends from said at least one actuator, said third cavity configured to receive a flow of fluid from said second cavity when said shaft retracts into said at least one actuator; and a second valve coupled in flow communication between said third cavity and said first cavity, said second valve configured to facilitate extension of said piston assembly.

9. The actuation system in accordance with claim 8 further comprising a reset valve coupled in flow communication between said third cavity and said second cavity, said reset valve configured to facilitate retraction of said piston assembly.

10. The actuation system in accordance with claim 9 wherein said MEMS controller is further configured to transmit a valve control signal to at least one of said first valve, said second valve, and said reset valve to facilitate commanded alternating opening and closing of at least one of said first valve, said second valve, and said reset valve.

11. The actuation system in accordance with claim 8 further comprising at least one position sensor operatively coupled to said pump, said at least one position sensor configured to detect a present position of said piston and transmit a position feedback signal to said MEMS controller to facilitate comparison and correction between a commanded position of said piston and the present position of said piston.

12. A gas turbine engine comprising:

at least one movable component;

at least one immovable component; and at least one actuator comprising:

a pump comprising:

a first cavity;

a diaphragm coupled in flow communication with said first cavity, said diaphragm configured to pressurize a fluid contained in said first cavity; and a first valve coupled in flow communication with said first cavity, said first valve configured to release fluid from said first cavity when said first cavity is pressurized;

a piston assembly operatively coupled to said pump, wherein said at least one actuator is coupled to and between said at least one movable component and said at least one immovable component, said at least one actuator configured to facilitate alternating movement of said at least one movable component relative to said at least one immovable component; and further comprising a micro-electromechanical systems (MEMS) controller and a MEMS module, said MEMS controller configured to transmit a MEMS control signal to said MEMS module to facilitate commanded movement of said diaphragm to pressurize said first cavity.

13. The gas turbine engine in accordance with claim 12, wherein said piston assembly further comprises a head and shaft, said actuator further comprising:

a second cavity defined between said first valve and said head;

a bias member configured to oppose a force acting on said head from said second cavity;

a third cavity configured to supply a flow of fluid to said first cavity when said shaft extends from said actuator, said third cavity configured to receive a flow of fluid from said second cavity when said shaft is being retracted into said actuator; and a second valve coupled in flow communication between said third cavity and said first cavity, said second valve configured to facilitate extension of said piston assembly.

14. The gas turbine engine in accordance with claim 13 further comprising a reset valve coupled in flow communication between said third cavity and said second cavity, said reset valve configured to facilitate retraction of said piston assembly.

15. The gas turbine engine in accordance with claim 14 wherein said MEMS controller is further configured to transmit a valve control signal to at least one of said first valve, said second valve, and said reset valve to facilitate commanded alternating opening and closing of at least one of said first valve, said second valve, and said reset valve.

16. The gas turbine engine in accordance with claim 12 further comprising at least one position sensor operatively coupled to said pump, said at least one position sensor configured to detect a present position of said piston and transmit a position feedback signal to said MEMS controller to facilitate comparison and correction between a commanded position of said piston and the present position of said piston.

17. The gas turbine engine in accordance with claim 12, wherein:

said at least one movable component comprises at least one of at least one variable bleed valve door and at least one ring, said at least one ring rotatably coupled to at least one variable stator vane, said at least one variable stator vane coupled to said gas turbine engine; and said at least one immovable component comprises at least one of at least one liner assembly and at least one fan frame.

* * * * *